United States Patent [19]

Treschitta

[11] 4,051,702

[45] Oct. 4, 1977

[54] MAGNETICALLY OPERATED SWITCH LOCK AND KEY THEREFOR

[75] Inventor: John Phillip Treschitta, South Norwalk, Conn.

[73] Assignee: Bunker Ramo Corporation, Oak Brook, Ill.

[21] Appl. No.: 599,692

[22] Filed: July 28, 1975

[51] Int. Cl.[2] ..... E05B 47/00; H01H 27/00

[52] U.S. Cl. ..... 70/276; 70/413; 70/57; 200/16 D; 200/44; 335/207

[58] Field of Search ..... 70/276, 413, 339; 200/44, 16 D; 335/207

[56] References Cited

U.S. PATENT DOCUMENTS

| | | | |
|---|---|---|---|
| 1,336,306 | 4/1920 | Lohse | 200/44 |
| 3,025,372 | 3/1962 | Benson | 335/207 |
| 3,602,020 | 8/1971 | Kajita | 70/413 |
| 3,837,195 | 9/1974 | Pelto | 70/276 |
| 3,837,525 | 9/1974 | Kobayashi | 70/276 |

*Primary Examiner*—Paul R. Gilliam
*Assistant Examiner*—Kenneth J. Dorner
*Attorney, Agent, or Firm*—William Lohff; F. M. Arbuckle

[57] ABSTRACT

The following specification describes a magnetically operated lock for a coaxial switch in which slide member is operated in opposite directions by a slide magnet in a key to connect an incoming coax line to either another coax line or to ground through a characteristic impedance termination.

The key has a configuration corresponding to the lock housing and when associated with the lock housing, automatically positions a plurality of spaced magnets in the key to operate a plurality of pins in opposite directions to unlock the slide. Removal or disengagement of the key from the lock housing enables the pins in the lock to engage the slide and lock the switch in either position to which it is operated.

14 Claims, 7 Drawing Figures

MAGNETICALLY OPERATED SWITCH LOCK AND KEY THEREFOR

FIELD OF THE INVENTION

This invention relates in general to magnetically operated locks and more particularly, to an improved and more economical magnetically operated lock for use in controlling a coaxial switch.

SUMMARY OF THE PRIOR ART

Cable antenna television commonly known as CATV can employ the coaxial switch at the subscriber location for either connecting the CATV line to the subscriber line or to ground through a characteristic impedance termination. The switch is usually located on a support external to the subscriber's premises and, once installed, is available for operation by a serviceman for either connecting or disconnecting the CATV line to the subscriber line, depending on whether the service is desired or not or has been paid for.

In one form of switch arranged to prevent unauthorized operation or tampering, an enclosure having a pivot arm, including magnetically susceptible material, and carrying a magnet, closes a reed switch when the arm and magnet are in one position. The pivot arm has a series of openings in which a locking tab may engage to lock the arm. When a key containing a magnet is placed on the enclosure, the arm is lifted from the locking tab and the magnet in the key is then moved to pivot the arm and its magnet away from the switch for example, and on removal of the key and its magnet, the locking tab or detent can engage one of the holes in the pivot or lever arm. This arrangement has several disadvantages since it is relatively expensive and may be operated by unauthorized personnel through use of a single magnet since apparently no code is required and in addition, creates problems in ensuring proper location of the pivot arm relative to the switch and locking tab.

Other magnetically operated locks often require key magnets arranged to both attract and repel corresponding locking elements in the lock for movement in opposite directions to frustrate the unauthorized use of a single key magnet. In addition, magnetic locks may utilize an access opening for enabling insertion of an appropriate operating element thereby permitting physical access to the actuating member of the lock.

The arrangement of locking elements for both attractive and repelling movement contributes to the expense of magnetically operated locks while the use of an access opening often enables the purpose of the lock to be frustrated. In addition, magnetic locks are not easily adapted for use with a coaxial switch.

SUMMARY OF THE INVENTION

The present invention utilizes a lock assembly having no access opening and the lock includes a plurality of spacially coded pins or locking elements located beneath a plurality of external surfaces of the housing and operated in response to respective spacially coded key magnets to release the locking elements and permit operation of the lock and associated coaxial switch. Thus unauthorized operation of the lock cannot be accomplished by tampering at an access opening or through a single external surface or by the use of a single magnet while the locking elements and key magnets are all arranged for one type of magnetic force or field.

To provide these functions, the lock housing and key housing have complementary shapes or configurations enabling the key to be fitted over two or more external surfaces of the lock housing and magnetically release the locking elements. When the key is moved to an unlocking position over the lock housing, the key is controlled by the complementary external shape of the housing to automatically position magnets in the key adjacent respective pins or locking elements, which are located on opposite sides of a slide in the lock. The pins on opposite sides of the slides are normally biased in opposite directions toward the slide to lock the slide in either of two limit positions so that the key magnets move the pins against their bias and in opposite directions for releasing the slide in the lock. The magnets can thus all be arranged to provide a magnetic field polarized in the same direction and attract their respective pins and yet more than one magnet is required to release the slide. Of course, if desired or required, the direction of the magnetic fields may all be arranged for repelling action.

The key also includes a movable slide having a magnet automatically positioned relative the slide or actuating member in the lock when the key is properly engaged with the lock. The lock slide carries a magnetically susceptible material and when the key magnet is moved, the lock slide follows to either of the two limit positions without requiring physical access to the slide in the lock and ensures that slide in the lock is in either desired position.

The lock slide is operatively connected to a bridging member or contact of a single pole double throw coaxial switch and when the lock slide is operated to one limit position, the bridging member connects an incoming CATV line to a subscriber line and when the lock slide is operated to the second limit position, the bridging member connects the incoming CATV line to ground through a characteristic impedance termination.

It is therefore among the primary objects of the present invention to provide an improved or more reliable magnetically operated lock and additionally provide a key for use therewith operative magnetically through two or more external surfaces of a lock housing.

It is also among the objects of the present invention to provide a more economical or improved magnetically operated lock for use with a coaxial switch and additionally provide a key for use therewith.

It is among the further objects of the present invention to provide an improved lock system and/or locking method.

The above and other objects of the invention, together with various features of the invention, will become apparent on examination of the following specification and claims in conjunction with the drawings.

DESCRIPTION OF THE PREFERRED EMBODIMENT

Figure 1:
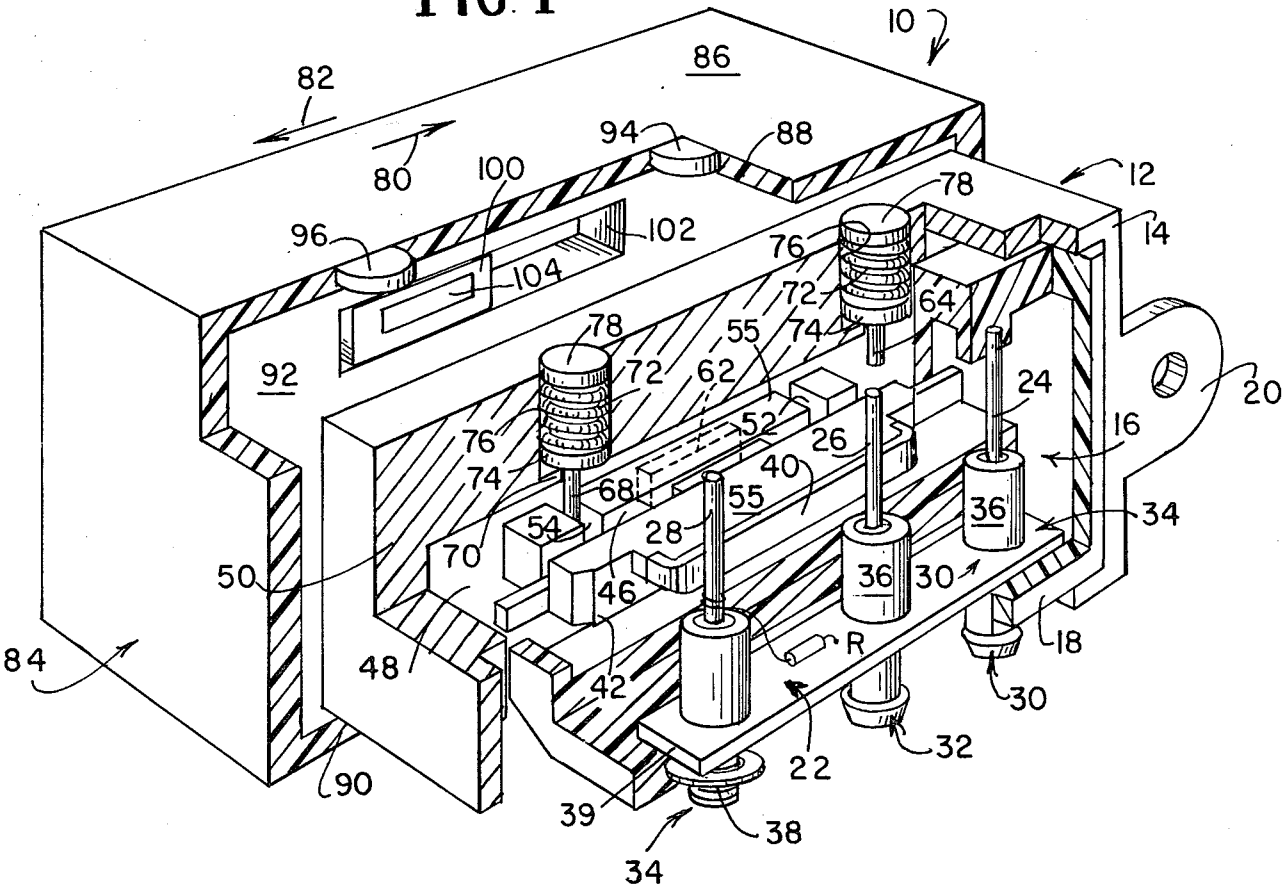
FIG. 1 is an exploded view partially broken away of the lock and switch assembly and the key associated therewith.
Figure 2:
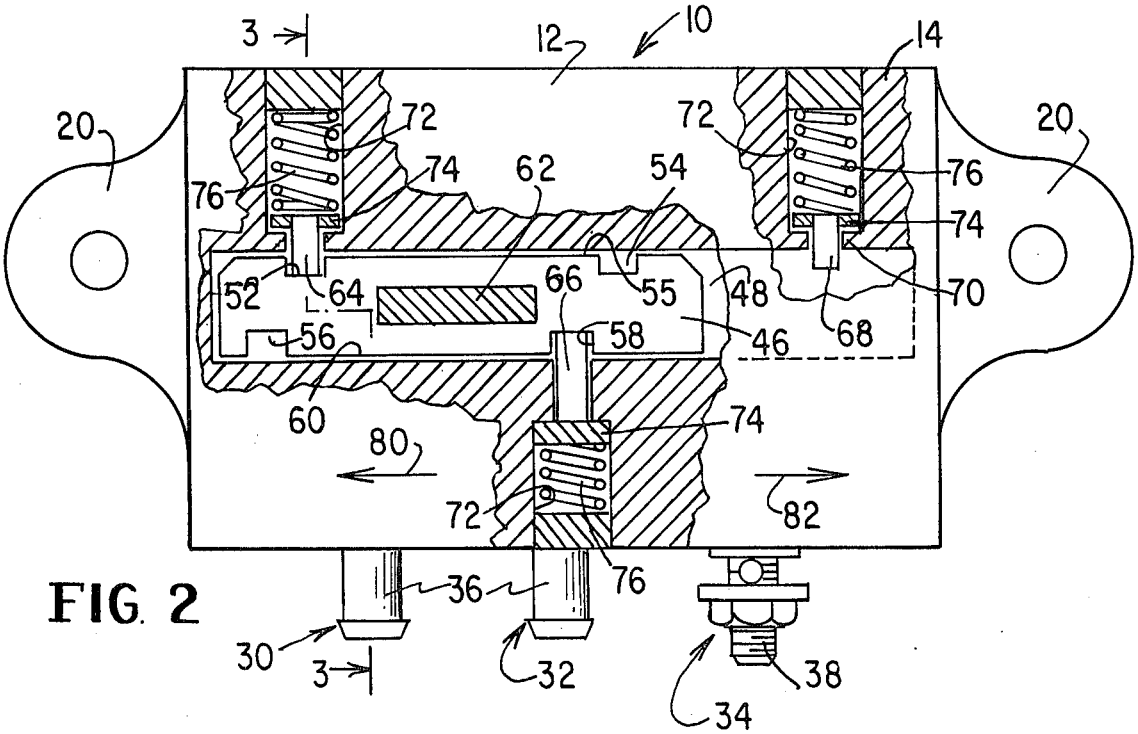
FIG. 2 is a front elevational view of the switch and lock assembly with the lock housing partially broken away.

In FIGS. 1 and 2 of the drawings, a coaxial switch and magnetic lock assembly incorporating the principles of the present invention is indicated generally by the reference character 10. The assembly 10 includes a lock assembly 12 carried in an enclosure or housing 14 and a coaxial switch assembly 16 carried in an insulating or plastic enclosure or switch housing 18 seen in cross section in FIG. 3. The housing 14, which is secured in overlapping relationship to the front, top and side surfaces of housing 18, is also of a non-magnetic material such as plastic or of diecast metal, for example, and is provided with apertured ears 20 projecting in opposite longitudinal directions for mounting of the assembly 10 on a support structure.

Figure 6:
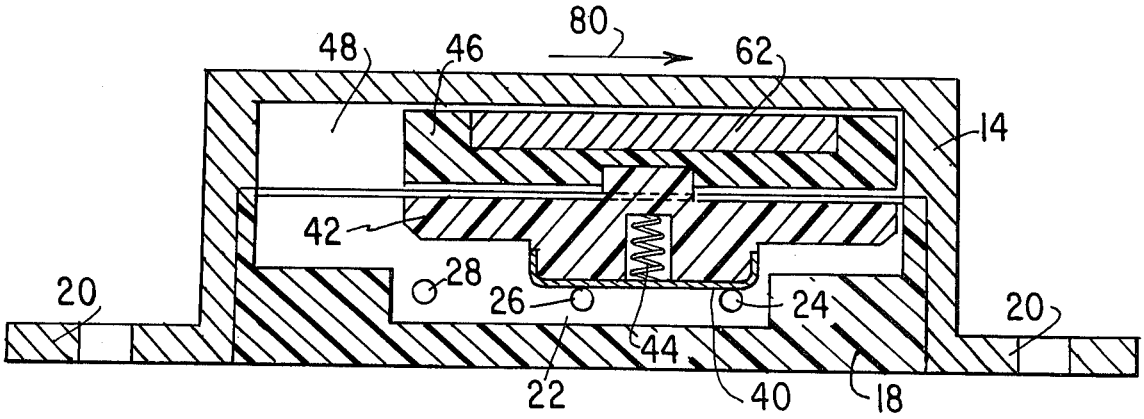
FIG. 6 is a sectional view illustrating the lock and switch slides and bridging member in one limit position.
Figure 7:
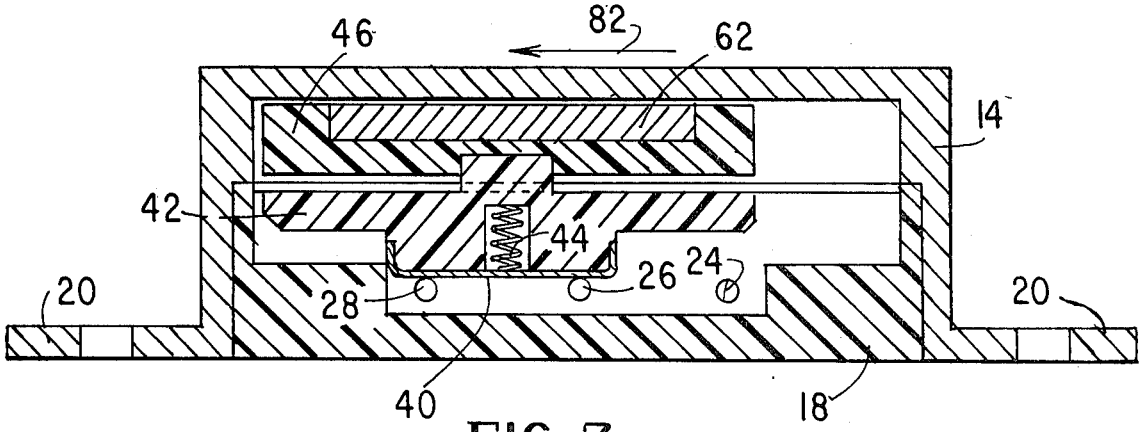
FIG. 7 is a view similar to FIG. 6 illustrating the lock and switch slides and bridging member in the other limit position.

The housing 18 has a cavity 22 in which are located spaced center contacts or terminals 24, 26 and 28, best seen in FIGS. 1, 6 and 7 of respective coaxial terminal assemblies 30, 32 and 34. Terminal assemblies 30 and 32 include a respective annular outer portion 36 projecting from the cavity 22 and external to the housing 18 for securing to the external conductor of a coax cable thereto with the center conductor of the coax cable projecting into housing 18 to engage the respective center terminals 24 and 26. Terminal assembly 34 is provided with a conventional outer stud portion 38 projecting from the cavity for connection to ground and is connected to its center contact or terminal 28 through a characteristic 756 ohm impedance R located in the cavity 22.

The terminal assembly 32 serves, for example, as an input terminal from an external CATV line while terminal assembly 30 serves to connect an input line to the subscriber's television set or other appliance. The stud portion 38 of terminal assembly 34 serves as a conventional grounding terminal through the characteristic impedance, when it is desired to disconnect the subscriber's line from the CATV line. The outer conductors of the coax cables are connected to ground through a strap 39, which connects portions 36 to stud 38. Shielding for the terminal assemblies may be provided by either fashioning one of the housings of non-magnetic metal or providing a metal shield in one of the housings in overlapping relationship to the terminals.

Figure 3:
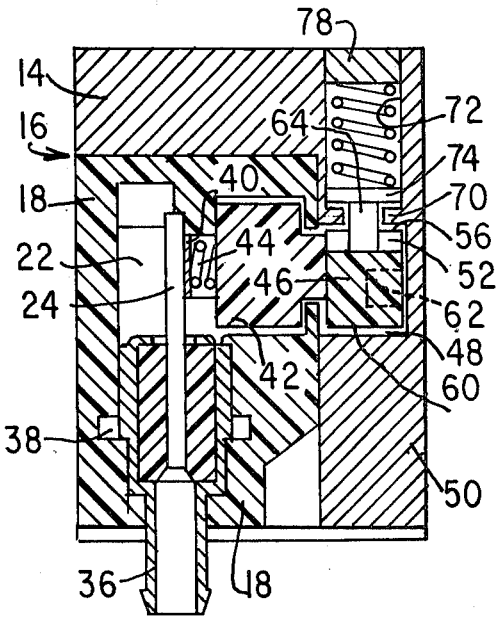
FIG. 3 is a sectional view taken generally along the line 3—3 in FIG. 2.
Figure 4:
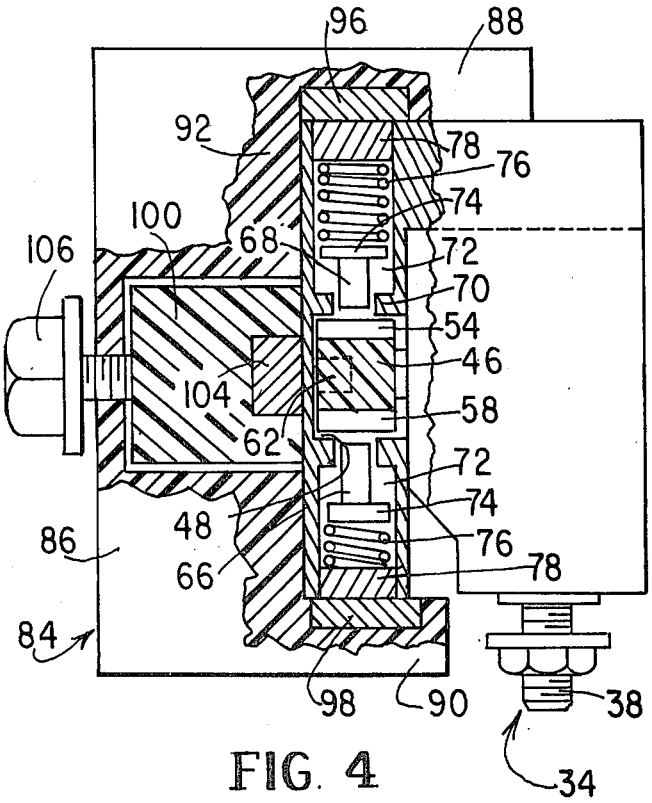
FIG. 4 is a sectional view taken through another portion of the lock assembly and showing the key assembly associated therewith.

A conductive bridging member or metal switch pole 40, carried on a slide 42 of insulating material located in cavity 22 connects intermediate terminal 26 to either terminal 24 or terminal 28 and is biased against or in the direction of the terminals by a spring 44 as best seen in FIGS. 3, 6 and 7. The slide or member 42 is generally rectangular in cross section and fits in a correspondingly shaped keyway portion of cavity 22 in a position offset from the center terminals whereby its movement is confined to the longitudinal or horizontal axis of the housing 14 and 18 as viewed in FIGS. 2, 6 and 7 of the drawings for connecting center terminal 26 to either the subscriber terminal 24 or to ground through the terminal 28 and the characteristic impedance not shown.

The slide 42 has a projecting portion of reduced cross-section extending through the front wall of housing 18, and is attached to a second slide or member 46 of non-magnetic material in housing 14 of the lock assembly 12.

The actuating member or lock slide 46 is positioned in a keyway or guideway 48 located in one wall or leg 50 of the housing 14. The one wall 50 overlappingly engages the front face of housing 16 and the other walls of housing 14 overlappingly engage with the top and side surfaces of housing 18 so that no access is provided to the bridging or bridge member 40. The outer surfaces of housing 14 are smooth or flat and uniformly finished so that when the back wall or surface of housing 18 is engaged with a support, the switch and lock assembly present no clues as to the manner of operation and physical or mechanical access to the slides, bridging member and terminals is normally prevented without disassembly.

The slide member 46 is provided with spaced recesses 52 and 54 along its upper margin or face 55 and spaced recesses 56 and 58 along its lower margin or face 60 as best seen in FIG. 2. Slide 46 also carries a recessed bar 62 of magnetically susceptible material arranged flush with the front surface of slide 46 and adjacent the front surface of wall 50 as best seen in FIGS. 6 and 7.

The recesses 52 and 58 are spaced for registration or alignment with respective pins 64 and 66 when the slides 42 and 46 are positioned to engage bridging member 40 with terminals 24 and 26 and recesses 54 and 58 are spaced for registration or alignment with pins 68 and 66 respectively when the slides 42 and 46 are positioned to engage bridging member 40 with terminals 26 and 28. Thus, recesses 56 and 58 are each adapted to be engaged by pin 66 located intermediate pins 64 and 68 relative the longitudinal axis of the slides and housings and below the slides and recesses 52 and 54 are adapted to be engaged by pins 64 and 68 respectively located above the slides.

All of the pins 64, 66 and 68 project into cavity 48 through a respective opening in a respective stop wall portion such as 70 formed in wall 50 between cavity or guideway 48 and cavity 72 formed in wall 50. The portion of each pin in its respective cavity 76 is secured to or has formed thereon a collar or shoulder 74 of magnetically susceptible material and forms therewith a locking element adjacent a respective surface of housing 14. Each pin 64, 66 and 68 is biased toward the respective face and recess of slide 46 by a respective spring 76 which is engaged between the respective collar 74 and a closure member 78 of non-magnetic material closing the end of the respective cavity 72 spaced from the stop wall 70. The pins and collars thus form a coded arrangement of respective spaced elements of magnetically susceptible material such as soft iron, for example, movable between a first or locking position and a second or release position.

Thus the housings 14 and 16 form an enclosure for the terminals, slides and bridging members which are inaccessible without disassembly and with the slides 42 and 46 in the position shown in FIGS. 1 and 6, the bridging member 40, which may be considered as the pole of a double throw switch, connects terminals 24 and 26 to connect to an incoming CATV coax line to a subscriber coax line and provide service to the subscriber. The slides 42 and 46 are locked in the one position by the pins 64 and 66 engaging the recesses 52 and 58 respectively of slide member 46. The movement of the slide members in the direction of arrow 80 along the longitudinal axis of housings 14 and 18 is limited by the left hand walls of the guideways or appropriate stops to ensure that the recesses 52 and 58 align or register with pins 64 and 66 respectively.

When the slides are moved along the longitudinal axis of each keyway in the opposite direction indicated by arrow 82, the bridging member 40 is, of course, disengaged from terminal 24 and instead engaged with terminal 28, while it remains engaged with terminal 26 to contact the incoming CATV cable to ground and disconnect the subscriber line from the CATV cable or line.

To move the slide members 42 and 46 to either position for engaging either terminal 24 or 28 with terminal 24, a key assembly 84 is provided. The key assembly 84 includes a U shaping housing 86 of non-magnetic material with legs 88 and 90 spaced for overlapping association or engagement with the top and bottom surfaces of wall 50 or housing 14 and a back wall 92 for association with or in abutting engagement with the front surface of wall 50 so that the wall 50 is nestingly received by housing 86. The orientation and/or spacing of the housing 86 relative the longitudinal axis of wall 50 may be controlled by the dimensioning of the parts and additionally, for example, by keys and keyways on the mating or engaging parts.

Figure 5:
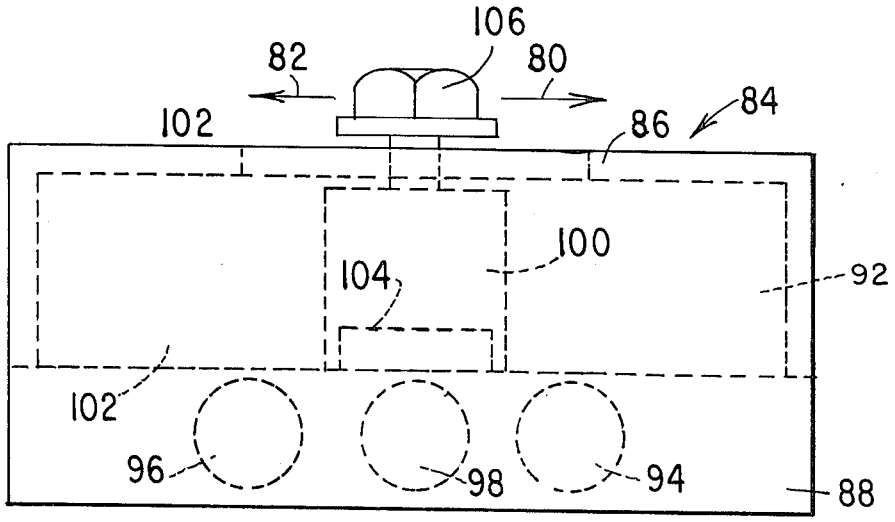
FIG. 5 is a top plan view of the key assembly.

A pair of spaced magnets 94 and 96 best seen in FIGS. 1 and 5 are fixedly carried by leg 88 and a magnet 98 is carried by leg 90 adjacent the juncture of the respective leg with back wall 92 and spaced for registration with respective ones of the collars 74, pins 64, 68 and 66 respectively to attract the collars 74 and their pins 64, 68 and 66 toward the respective magnets 94, 96 and 98 in response to the mating receipt of wall 50 by the key 84. The pin 66 is therefore moved in a direction opposite pins 64 and 68 against the bias of the respective springs 76.

Thus when the key 78 is associated with or assembled to the housing 14, the magnets 94 and 96 serve to attract pins 64 and 68 in one direction, while the magnet 98 attracts pin 66 in the opposite direction, thus eliminating the need for repelling and attracting actions in frustrating the unauthorized operation by, for example, a single magnet. All pins are therefore released or disengaged from slide 46 irrespective of whether the slide is in the position shown in FIGS. 1, 2, 5 or 6.

The back wall 92 of key assembly 84 also includes a slide or slide member 100 fitted for longitudinal movement in a guideway or keyway 102 and the slide member 100 carried a recessed operating magnet 104 at the inner surface of wall 92 for engaging the front surface of wall 50 in registry with the bar 62 in slide member 46. A knob 106 secured to the slide member 100 by a stem projecting through the surface of back wall 92, opposite wall 50, permits the serviceman or operator to move the slide 100 together with magnet 104 in either of the directions of arrows 80 or 82 with the movement in either direction being limited by a respective end wall to thereby move the bar 62 with its associated slides in the corresponding direction along the longitudinal or horizontal axis of housings 14 and 18 to move the bridge 40 to the desired position for connecting the terminal 26 either to terminal 24 or to terminal 28 as desired.

Thus, with the switch and lock assembly 10 located on a suitable support at or adjacent a subscriber's premises and an incoming CATV line connected to terminal assembly 32, the subscriber's line or cable connected to terminal assembly 30 and the terminal stud 38 connected to ground, an authorized operator to either connect the CATV line to the subscriber's line or to ground, places the key assembly 84 in the position shown in FIG. 3 relative to the switch and lock assembly 10. The bar 62 and the magnet 104 are dimensioned and preferably located along the horizontal axis between pins 64 and 66 or between pins 66 and 68, when the slides are in either limit position so that the magnet 104 does not affect the retraction of the pins.

The pins 64, 66 and 68 are retracted from their respective slots or recesses 52 and 58 or 54 and 56, dependent on the position of slides 42 and 46, in response to the application of a respective field by the release magnets 94 and 96 and the respective oppositely directed field supplied by release magnet 98. The slides and bridge are now unlocked and free to move irrespective of their positions and without requiring physical engagement. The key assembly 86 may, of course, be provided with additional means for locating or polarizing the key assembly relative the assembly 10, however, since the operator knows which side of the assembly 84 aligns magnets 94 and 96 with pins 64 and 68 and magnet 98 with pin 66, and since the opposite vertical ends or sides of the key assembly may correspond to the side margins of the wall 50, this presents no problem. With the pins retracted from their respective slots or recesses, the slides 42 and 46 are free to move and the operator moves knob 106 and slide 100 in the direction of either arrow 80 or arrow 82. The magnet 104 is carried in the corresponding direction and its field, moved in the selected direction and operating on the bar 62 of soft iron, for example, carries slides 42 and 46 together with member or pole 40 in the corresponding direction. When slide 100 and/or the stem projecting therefrom engage a respective stop or end wall, movement is terminated with the member 40 across either terminals 24 and 26 or 26 and 28.

The operator, to be sure that the bridge member 40 is moved to the proper position, may first operate the knob 106 to move the bridge member 40 across the contacts which he desires to disconnect, with the slides and knob in one limit position, and then he moves the knob 106 in the opposite direction along its linear path to the other limit position to move the bridging member 40 across the desired contacts or terminals for either connecting or disconnecting the subscriber's line from the CATV line. The operator now simply disengages the key assembly 84 from the switch and lock assembly 10. The pins 64, 66 and 68 under the bias of the respective springs 76, move into the keyway 48 and, either pins 64 and 68 enter recesses 52 and 58 respectively or the pins 66 and 68 enter recesses 56 and 54 respectively to lock the slides and bridging member in the respective position.

The applicant has thus provided a lock assembly 10 comprising an enclosure or housing 14 with two external surfaces located on wall 50 disposed in different planes with locking means including sensing means operated by a predetermined combination of fields applied through the surfaces to reach an energized safe and operating means responsive to the energized state for operation between first and second conditions with one condition being a locking condition. The locking means thus include elements or members 64, 66 and 68 and collars 74 operative to move individually between first and second positions with one position in a respective recess 52, 54, 56 and 58 and one of the locking elements or members 64 or 68 disposed in the housing adjacent one surface and the other locking member 66 disposed adjacent the other surface to form a coded arrangement of locking members or elements normally inaccessible through either surface. A system is also provided for locking a member 46 against unauthorized use comprising a lock mechanism or assembly 12 having a plurality of magnetically susceptible elements 74 and 64, 66 and 68 movably positioned to hold an actuating member 46 against movement in either of two positions; a housing 14 for the mechanism preventing physical access to the elements and actuating member with the housing having a predetermined or selected three dimensional configuration and a key 88 having a plurality of magnets 94, 96 and 98 each spaced for operating a selected one of the elements and having a configuration corresponding to the selected configuration for automatically positioning the magnets to operate the elements and enable movement of the actuating member.

The foregoing is a description of an improved magnetically operated lock and coaxial switch assembly together with a magnetic key assembly for use therewith, whose inventive concepts are believed set forth in the accompanying claims.

What is claimed is:

1. A controllable locking mechanism comprising:

an actuating member movable between two positions;

switch means connected to and operable by said actuating member to corresponding switch positions;

at least two release means operable to lock said actuating member and to release said actuating member and located in a coding arrangement;

an external lock housing preventing physical access to said actuating member and said release means with said housing including at least two external surfaces each adjacent a respective one of said release means;

key means including first actuating means having a corresponding coding arrangement to said release means and generating a plurality of fields for operating said release means;

a key housing mounting said first actuating means and having a configuration corresponding to said external lock housing for embracing said external lock housing and automatically positioning said first actuating means in operative relationship to said release means for operating said release means; and second actuating means carried by said housing for selectively operating said actuating member to said two positions.

2. A magnetic lock assembly for use in a switch including a member operable in either of two directions for respectively connecting one terminal to another terminal or for disconnecting said one terminal from said other terminal, the improvement comprising:

an enclosure for said one terminal and said other terminal, a slide in said enclosure for moving said member in either of said two directions for either connecting one terminal to said other terminal or for disconnecting said one terminal from said other terminal, a plurality of spaced magnetically susceptible elements in said enclosure each normally biased to a respective bias position for preventing movement of said slide in either of said directions and movable from the respective bias position in response to the application of a respective magnetic field to said elements, means for enabling the simultaneous retraction of said elements from the respective bias position to permit movement of said slide, and a magnetically susceptible material carried by said slide for enabling said slide to be moved in a selected one of the two directions without physically engaging the slide in response to the application of a respective magnetic field to said material and the movement of said respective field in the selected direction.

3. For use with the magnetic lock assembly claimed in claim 2, a key assembly including a housing having a configuration corresponding to said enclosure and sized for overlapping engagement with said enclosure, a plurality of magnets carried by said key assembly, each magnet spaced for registry with a respective one of the elements in a predetermined relation, said enclosure to supply a magnetic field for simultaneously moving each of said elements from the respective bias position, and a movable magnet carried by said key assembly for thereafter moving said magnetically susceptible material and said slide in a selected one of said directions in response to the movement of said movable magnet in a corresponding direction.

4. The assembly claimed in claim 3 in which said elements are biased in opposite directions transverse to each direction of movement of said slide to engage said slide.

5. The assembly claimed in claim 4 in which one magnet of said plurality of magnets is spaced in alignment with one of said elements for applying one field moving said one element transverse to the direction of movement of said slide and another one of said plurality of magnets is spaced in alignment with another one of said elements for applying a field of the same character as said one field for simultaneously moving said other element in a direction opposite the direction of movement of said one element.

6. The assembly claimed in claim 5 in which said slide is movable along a linear path between spaced limit positions.

7. The assembly claimed in claim 6 in which said switch is a coaxial switch having three spaced terminals with said member for respective connection to a CATV line, a subscriber line and ground with said member connecting said CATV line to said subscriber line in response to movement of said slide in one direction to one limit position and connecting said CATV line to ground in response to movement of said slide in the opposite direction to the other limit position.

8. In a magnetic lock assembly for use in a coaxial switch including a member operable for connecting one terminal to either another terminal or operable for disconnecting said one terminal from said other terminal and for connecting said one terminal to a third terminal, the improvement comprising:

an enclosure having a cavity in which said member and each of said terminals are located, magnetically operable slide means in said enclosure for moving said member for either connecting said one terminal to said other terminal or for disconnecting said one terminal from said other terminal and connecting said one terminal to said third terminal, a plurality of spaced magnetically susceptible elements in said enclosure, and bias means engaging and biasing each element toward said slide means to a respective bias position for preventing movement of said slide means with two of said elements biased toward said slide means in bias directions opposite to each other.

9. The improvement claimed in claim 8 in which said slide means is located intermediate said elements and has a recess in opposite surfaces thereof for receiving a respective one of said elements.

10. For use with the improvement claimed in claim 9, a key assembly including a housing having a pair of projecting legs for overlapping engagement with said enclosure and a wall intermediate said legs for engagement with said enclosure, a magnet carried by each leg of said key assembly housing with each magnet spaced for registry with a respective one of the elements in response to the overlapping engagement of said legs with said enclosure to move each element in a direction opposite the respective bias direction and from the respective bias position to enable movement of said slide means and member, and a magnet movable in either of two linear directions and carried in said wall for thereafter moving said magnetically susceptible material and said slide in a selected one of said linear directions in response to the movement of said movable magnet in a selected one of said linear directions.

11. In a magnetic key assembly for use with a magnet lock assembly of the type having an enclosure in which magnetically susceptible elements are movable in opposite directions for releasing a member carrying a magnetically susceptible material for movement in a selected one of two directions, the improvement comprising:

a key assembly including means for physical engagement with said enclosure such that said key assembly is fixed in a predetermined spacial relationship with said enclosure, a plurality of spaced release magnets carried by said key assembly, each magnet spaced for registry with a respective one of the elements in response to the physical engagement of said key assembly means with said enclosure to move said elements in said opposite directions to release said member carrying said material, and an operating magnet movable in either of said two directions carried by said key assembly for thereafter moving said magnetically susceptible material and said member in a selected one of said two directions.

12. In key assembly claimed in claim 11 in which said operating magnet is spaced adjacent said member and physically separated therefrom by said enclosure in response to the physical engagement of said key assembly means with said enclosure, and said operating magnet is located intermediate said release magnets.

13. In the key assembly claimed in claim 12, a guideway in said key assembly for controlling said operating magnet to move in a linear direction between opposite limit positions.

14. A magnetic lock assembly for use in a switch including a member operable in either of two directions for respectively connecting one terminal to another terminal or for disconnecting the one terminal from the other terminal, the improvement comprising:

an enclosure for the one terminal and the other terminal;

a slide mounted in said enclosure for moving the member in either of said two directions;

a plurality of spaced movable magnetically susceptible elements mounted in said enclosure each normally biased to engage and latch said slide to prevent movement in either direction;

means for enabling delatching movement of said magnetically susceptible elements;

magnetically susceptible material carried by said slide; and magnetic means for magnetic coupling to said magnetically susceptible material carried by said slide to move said slide in either direction.

* * * * *